United States Patent [19]

Kazan

[11] Patent Number: 4,801,850

[45] Date of Patent: Jan. 31, 1989

[54] HIGH BRIGHTNESS VACUUM FLUORESCENT DISPLAY (VFD) DEVICES

[75] Inventor: Benjamin Kazan, Los Altos, Calif.

[73] Assignee: Xerox Corporation, Stamford, Conn.

[21] Appl. No.: 78,740

[22] Filed: Jul. 28, 1987

[51] Int. Cl.[4] ..... G09G 310

[52] U.S. Cl. ..... 315/169.3; 315/169.1

[58] Field of Search ..... 313/391; 315/12 R, 169.3, 315/169.1

[56] References Cited

U.S. PATENT DOCUMENTS

| | | | |
|---|---|---|---|
| 2,186,393 | 1/1940 | Ring | 315/12.1 |
| 3,710,173 | 1/1973 | Hutchins et al. | 315/12.1 |
| 4,459,514 | 7/1910 | Morimoto et al. | 315/169.1 |

OTHER PUBLICATIONS

B. Kazan et al, Electronic Image Storage, Academic Press, pp. 1–11, 16–27 & 225–230, 1968.

J. Rajchman, "The Selective Electrostatic Storage Tube", RCA Review, vol. 12(1), pp. 53–97, Mar., 1951.

"A Large-Screen Display . . . " by Curtin et al, 1973 SID International Symp. Digest of Tech. Papers, pp. 98,99 (1973).

*Primary Examiner*—David K. Moore

[57] ABSTRACT

Improved high brightness vacuum fluorescent display (VFD) devices are disclosed. In one case, an improved bistable phosphor view tube comprises a writing gun control grid, a writing gun anode and deflection means supported in a vacuum sealed tube envelope for deflecting an electron beam across a phosphor target layer at the front face of the tube wherein the improvement comprises an area cathode supported in close spaced proximity to the target layer to produce a two dimensional flood electron current over the full extent of the target phosphor target layer. In another case, an improved vacuum fluorescent display device utilizes phosphor anode elements that are electrically floating to function as a bistable elements wherein the phosphor layer portions may be selectively change to a stable second equilibrium potential state or remain at a stable first equilibrium potential state.

12 Claims, 6 Drawing Sheets

HIGH BRIGHTNESS VACUUM FLUORESCENT DISPLAY (VFD) DEVICES

BACKGROUND OF THE INVENTION

This invention relates to vacuum fluorescent displays (VFDs) and more particularly to improvements allowing much higher brightness level to be obtained than in such displays known in the art.

In recent years, vacuum fluorescent display (VFD) devices, utilizing phosphor display elements to form a viewed alphanumeric or graphic image, have come into wide use as displays in electronic and electrical appliances, such as audio receivers, calculators, measuring instruments and xerographic copiers. They are now also of growing interest for automobiles as a replacement for the cluster of electro-mechanical dashboard meters. VFD displays are basically three element vacuum tubes whose envelope is at least in part transparent. The envelope encloses, in spaced relation, a directly heated filamentary cathode, a set of metallic control grids and phosphor coated anode strips or segments. Upon application of a prescribed voltage across the ends of the oxide coated cathode filament or set of filaments, its temperature is raised to about 650° C. causing it to emit electrons and produce an electron flow. The control grids are located between the cathode and the anodes and through the application of a positive voltage with respect to the cathode to a selected grid electrode, the electrons are drawn from the cathode through this grid to the neighborhood of the anodes adjacent to the grid. If the grid is held at a negative potential, electron flow to the corresponding anodes is cut off.

Those electrons that pass through a positive grid and approach the surface of a particular anode will be repelled by the anode and prevented from landing if the anode is at the same potential or a negative potential with respect to the cathode. However, if a particular anode and its overlying selected grid are simultaneously made positive (anode addressing), electrons that pass through the grid will land on the anode and, because of their kinetic energy, will excite the phosphor coating of this anode, generating luminescence.

For applications requiring a large number of display elements, VFDs have been developed in which the grids and display anodes are arranged in the form of two sets of mutually orthogonal strips. In operation, successive grids corresponding to the rows of the display are pulsed positive while appropriate input signals in the form of positive pulses are simultaneously applied to the anode strips. As the number of rows of display elements is increased, however, the fraction of the time that a particular display element is on, i.e., its duty cycle, is reduced so that higher and higher voltage is required on the display anodes to produce a given average brightness. For example, a vacuum fluorescent display having 256 rows of disply elements required pulse voltages applied to the display anodes to be raised to about 150 volts in order to produce an average brightness of about 25 foot lamberts. For displays with a higher resolution, i.e., a significantly greater number of rows of elements, a corresponding increase in the magnitude of the anode pulse voltages is required to maintain the brightness. Where an even higher brightness is needed, a further increase in the pulse voltages is required. Aside from problems of panel design, operation at such high voltages, e.g. in excess of 200 volts, results in problems of power dissipation and requires special, relatively costly, integrated circuit devices capable of handling these high voltage and power levels. Prior art VFD devices are thus limited in brightness and resolution because of these considerations.

It is a principal object of this invention to achieve a high degree of brightness in vacuum fluorescent displays without being limited by the sequential addressing of successive rows of display elements. Another object of this invention is to provide a flicker-free display which can be addressed at an arbitrarily slow rate.

SUMMARY OF THE INVENTION

According to this invention, a vacuum fluorescent display (VFD) device utilizes phosphor display elements which have an electrically floating surface. With the aid of a suitably positioned collector electrode, the phosphor elements can be made electronically bistable whereby the surface of the phosphor coating of the anode elements may be selectively held in one of two different states, either in a low equilibrium potential state wherein the phosphor remains unexcited, emitting little or no light, or in a high equilibrium potential state wherein the phosphor luminesces brightly. The display device of this invention has the further advantage over prior art VFD devices in not requiring continuous addressing or refreshing of the image since the fluorescent element portions or segments making up the two dimensional image remain either in their OFF state or in their ON state indefinitely without requiring any additional input signals.

Another aspect of this invention relates to the use of an area cathode supported in close spaced proximity to the target layer at the front end of a bistable phosphor view tube to produce a two dimensional flood electron current over the substantial extent of the target layer.

Other objects and attainments together with a fuller understanding of the invention will become apparent and appreciated by referring to the following description and claims taken in conjunction with the accompanying drawings.

Figure 7:
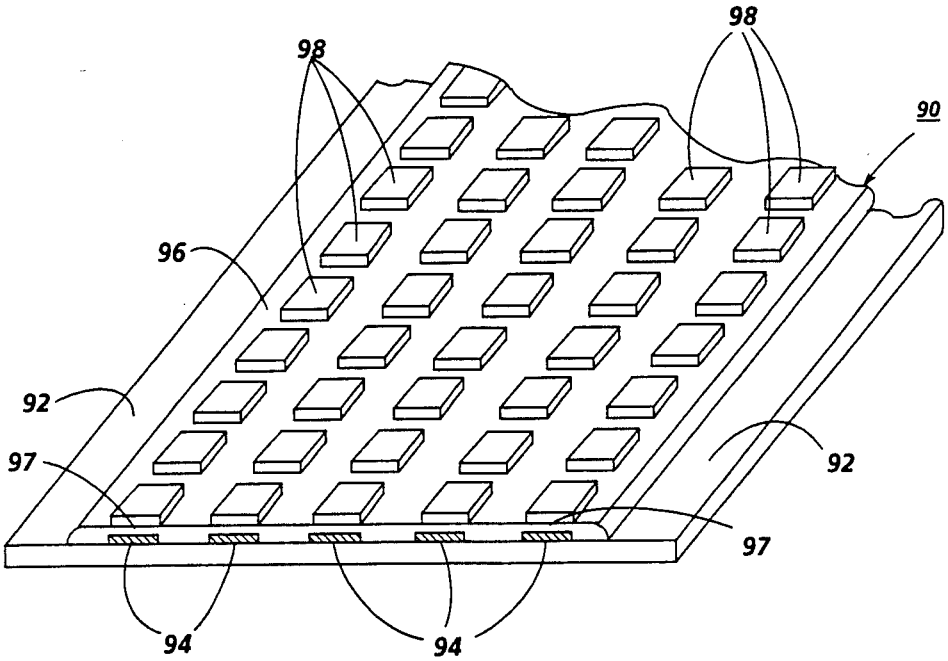

FIG. 7 is an isomeric view of another embodiment of the anode target structure for the VFD device of this invention.

DETAILED DESCRIPTION OF THE PREFERRED EMBODIMENTS

Figure 1:
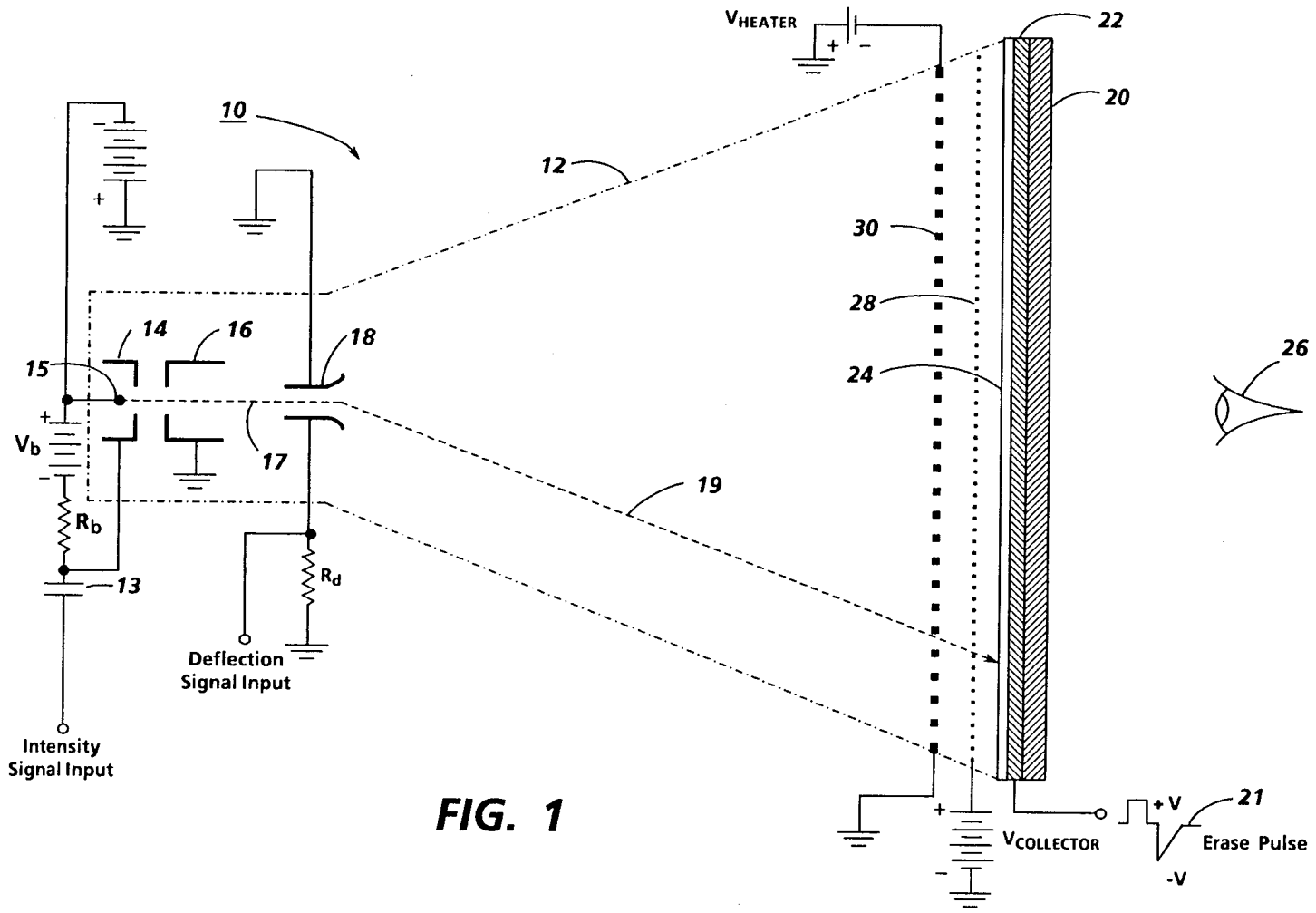
FIG. 1 is a schematic illustration of a side elevation of an improved electron beam addressed, bistable phosphor viewing tube comprising this invention.

Reference is made to FIG. 1 wherein there is shown on improved bistable phosphor view tube 10 employing some of the concepts of this invention. Tube 10 is basically a bistable storage tube known in the art and comprises a writing gun control grid 14 and a switching gun anode 16 supported in a vacuum sealed tube envelope 12. Forward of anode 16 are a set of deflection plates 18. As is known in the art, by means of a suitable supply voltage, $V_b$, e.g. −30 volts, applied to grid 14, the electron beam from cathode 15 is cut off unless positive pulses of sufficient magnitude are applied to this grid through coupling capacitor 13. The purpose of anode 16 is to focus the beam of electrons produced by cathode 15 into a narrow electron beam 17. Beam 17 passes between two sets of deflection plates oriented in orthogonal directions, with only the horizontal deflection plates 18 being shown in FIG. 1, and is deflected by a deflection beam modulation signal imposed on plates 18 to deflect the beam in orthogonal directions across a phosphor target layer 24, as represented by deflected writing beam 19. Thus, writing of a stored trace on phosphor layer 24 by beam 19 is accomplished in a conventional manner by the canning of writing beam in accordance with input signals applied to the deflection plates 18 and writing gun control grid 14. However, the maintenance of a stored composite image on phosphor target layer 24 is accomplished by a different structural concept compared to that conventional in the art, as will be explained in detail later.

A transparent glass plate 20 is provided at the forward end of tube 10 which is hermetically sealed to tube envelope 12. A conducting backplate 22 is formed on the inner surface of plate 20. Next a thin phosphor layer 24 is deposited on the surface of backplate 22. Backplate 22 and anode target layer 24 are transparent in order that an image formed on phosphor layer 24 may be seen at viewpoint 26.

In close spaced, parallel proximity to phosphor layer 24 is collector 28 which comprises a screen or mesh held at a positive potential, $V_{collector}$, e.g. +150 volts. In close spaced, parallel proximity to collector 28 is a cathode 30, which may be comprised of an array of oxide coated fine parallel wires extending across the full area of phosphor target 24 whose wire diameter, e.g. is about 25 μm or less so as not to appreciably intercept the electron current of writing beam 19. The end of cathode wires 30 may be is connected to either a low voltage dc power supply, $V_{HEATER}$, of either of ±5 volts or less or ac voltage of the same magnitude, while the other side of cathode 30 is connected to ground. For all practical purposes, all parts of cathode 30 are assumed to be close to ground or reference potential. When voltage is applied across cathode 30, the wires are maintained in a heated state, emitting a flood of primary electrons which are accelerated toward the surface of phosphor target layer 24 by the positive potential applied to collector 28.

Tube 10 is different from bistable tubes known in the art in that the continued flood of electrons necessary to maintain an image on phosphor layer 24 after writing with beam 19 is produced by a large area flat cathode structure close to collector 28 instead of one or more electron flood guns positioned at the back of the tube and requiring careful collimation.

Thus, one important aspect of this invention is that, unlike bistable storage tubes where the flood electrons are generated by one or more electron gun structures positioned at a substantial distance from the target (disclosed in FIG. IV-3 on page 226 of the book, "Electronic Image Storage" by B. Kazan et al, pp. 225–230, Academic Press, 1968) in the structure of the present invention the flood beam is generated by a two dimensional cathode 30 in the form of a grid of thin oxide coated heater wires positioned close to the phosphor screen. This cathode arrangement also makes possible a much higher electron current density to be obtained, e.g., of the order of one milliampere/cm$^2$, compared to 10 microamperes/cm$^2$ obtained in such tubes utilizing a conventional flood gun. Associated with this large increase in current density is a corresponding increase in brightness of the written and stored image which may be on the order of 500 foot lamberts or more, instead of about 5 foot lamberts obtained in conventional tubes, thereby enabling high contrast images to be obtained even under conditions of high ambient illumination, such as might be encountered in dashboard automotive displays.

In operation of tube 10, it is presumed that the tube target layer 24 is in its erased condition. As a result of an erase pulse, such as pulse 21, having been applied to backplate 22, causing the phosphor surface to shift to an equilibrium potential state close to that of the grounded area cathode 30 by means of the flood of electrons from cathode 30. This action results from the fact that any electrons landing on the target have a secondary emission ratio less than unity, i.e. operation is well below the first cross over potential of target 24. During writing, with the flood electrons from cathode 30 landing on phosphor target 24, writing beam 19 is scanned and current modulated in accordance with input signals. Collector 28 and cathode 30 are relatively transparent to the electrons of writing beam 19. Since the writing gun cathode 15 is maintained at a high negative potential, the electrons in write beam 19 landing at addressed points on target 24 is sufficient to produce a secondary emission ratio greater than unity. As a result, the surface of bombarded phosphor elements addressed by beam 19 will be shifted positive, assuming sufficient current density in writing beam 19 to overcome the tendency of the flood area electrons to hold these elements at the low equilibrium potential state. As soon as these elements are shifted above the first crossover potential, the flooding electrons from cathode 30 then also act to shift these addressed elements more positive, until they reach the higher equilibrium potential state, approximately equal to the positive potential of collector 28, e.g., in this case, about +150 volts. These elements then continue to be held at this equilibrium potential as long as the flooding electrons are allowed to reach them.

The foregoing, as is well known from the technical literature, is based upon the fact that a floating target or an insulating surface bombarded by electrons in a vacuum will remain at one of two equilibrium potentials, namely at either the potential of the electron emitter or cathode or at the potential of a collector located between the cathode and the floating target, assuming that the collector is maintained at a sufficiently positive potential relative to the cathode. Examples of this are found in the article of J. Raichman entitled, "The Selective Electrostatic Storage Tube", RCA Review, Vol. 12(1), pp. 53–97 and in the book, "Electronic Image Storage" by B. Kazan et al, pp. 16–27, Academic Press, 1968.

This phenomenon is made use of in the Tektronix bistable viewing, storage tube described in FIG. IV-3 on page 226 of the book, "Electronic Image Storage" by B. Kazan et al, pp. 225–230, Academic Press, 1968, in which case the viewing tube has a floating target consisting of an insulating phosphor layer whose local surface areas can be switched from cathode to collector potential by means of an auxiliary writing beam and then held at these equilibrium potentials by a flooding beam of electrons. Because of the luminescent property of the target surface a visible image is produced since those areas held at collector potential are bombarded by flood electrons which land with a substantial energy while those areas held at flood gun potential prevent electrons from landing with any significant energy and remain dark.

In the present invention, use is made of this same bistable phenomenon. However, instead of using a current modulated scanning writing beam to establish the charge pattern and resulting luminescent image on the phosphor layer, a multiplicity of electrically floating phosphor elements are employed which can be individually switched from their "ON" to "OFF" states or vice versa in accordance with appropriate electrical input signals applied directly the backing electrodes of the individual phosphor elements.

To avoid the need for providing a separate drive circuit for each picture or pixel element and to avoid problems of distributing the time varying input signals to these drive circuits, an X-Y system of addressing scheme is utilized wherein a phosphor coating is deposited on the surface of a set of electrode strips forming the anode target electrodes. Oriented perpendicular to these strips is a set of grid electrode strips which control the transmission of electrons to corresponding areas of the target electrodes. By applying suitable potentials to these two different sets of electrodes, individual elements of the display can be switched on or off in a line-by-line manner to produce a complete stored image. The resulting luminescent image can then be retained indefinitely if the phosphor elements are continually flooded with electrons. When desired, all or part of this image can be erased or a new image may be written and displayed.

Figure 2:
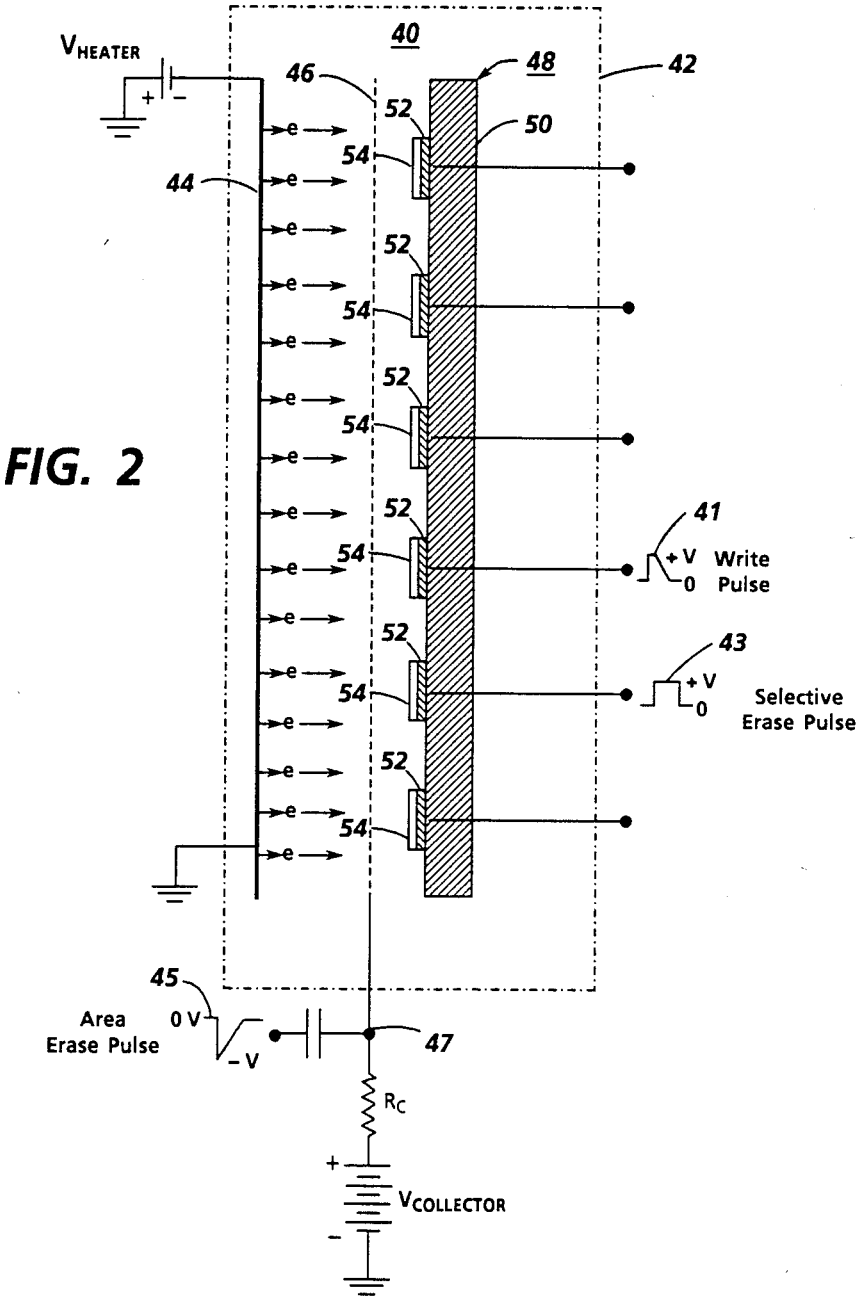
FIG. 2 is a schematic illustration of the basic operating components of a vacuum fluorescent display device comprising this invention for the purpose of discussion of the fundamental operation of the present invention vis a vis the prior art.

In illustration of the foregoing concepts of the present invention, reference is now made to FIG. 2 utilizing the bistable phenomenon in a vacuum fluorescent display (VFD) structure 40.

In FIG. 2, VFD structure 40 comprises a vacuum sealed envelope 42 containing the following two dimensional area components: an area cathode 44, an area collector 46 and an anode structure 48. Cathode 44 comprises an array of oxide coated fine wires connected at one end to a low voltage source, $V_{HEATER}$, e.g. several volts, and the other end thereof connected to reference or ground potential. The voltage $V_{HEATER}$, serves to maintain the cathode wires in a sufficiently heated state to emit a flood of primary electrons which are then accelerated toward collector 46 and anode structure 48. Collector 46 may be comprised of a fine wire mesh or screen and is held at a positive potential, e.g. +100 volts.

Anode structure 48 comprises an insulating substrate 50 upon which are formed a series of parallel conducting strips 52 which are coated with insulating or high resistance phosphor material 54, such as, $Zn_2SiO_4$, or other such cathodoluminescent phosphor.

In operation of VFD structure 40, the surface of phosphor material 54 is electrically floating due to the insulating or high resistance property of the material. The surface of electron bombarded phosphor elements can then be switched from one equilibrium potential to the other by applying appropriate writing pulses 41 or erasing pulss 43 to selected conductor strips 52. Pulses 41 are employed to switch the phosphor elements 54 from a low equilibrium potential state to a high equilibrium potential state while pulses 43 are employed to switch the equilibrium potential of the phosphor elements 54 from a high equilibrium potential state to a low equilibrium potential state.

Assuming that the current density of electrons approaching the phosphor elements 54 is about 1 $mA/cm^2$, the write erase pulse durations may be on the order of a millisecond or less. In operation of VFD structure 40, it is presumed that all phosphor elements 54 are initially at their low equilibrium potential state, i.e., at or near ground due to previous erasure. By means of the flood of electrons reaching elements 54 through collector 46, these elements are maintained in their low potential equilibrium state. With the application of positive write pulse 41, e.g. +100 volts having a rapid rise and long decay time, to one or more conductor strips 52, the potential at the surface of elements 54, so addressed, is suddenly shifted positive to +100 volts. Electrons from cathode 44 are permitted to land on the addressed phosphor elements 54. As write pulse 41 slowly decays, the surface of the bombarded elements is maintained at collector potential as a result of electrons continuing to land with a secondary emission ratio greater than unity. At the termination of the pulse, elements 54 will remain at +100 volts and continue to emit light. Because of the relatively high current density of the flooding electrons landing on the bombarded elements 54, they will have a high brightness level, e.g., on the other of 500 foot lamberts or more.

Selected floating phosphor target elements 54 maybe erased, i.e., ON elements may be switched OFF, by the application of a selective erase pulse 43 to elements 54. Selective erase pulse 43, e.g., +100 volts in magnitude, is rectangular in shape and has very short rise and fall times. If such a pulse is applied to a previously addressed element which is already at +100 volts, this element will be suddenly raised to a +200 volt level. As a result, electrons from cathode 44 will land on selected elements 54. Since the secondary electrons released by these electrons are prevented from leaving these elements by the decelerating field between the collector and these selected elements, they are caused to charge negative until they shift to the equilibrium potential corresponding to collector 46. Upon termination of the write pulse, the selected elements will suddenly be shifted to cathode potential and then remain at this equilibrium potential, i.e., the OFF condition, upon continued flooding with electrons from area cathode 44.

Alternatively, all floating phospor elements 54 may be erased by applying area erase pulse 45 to collector 46. The negative pulse 45 acts to shift collector 46 to a low potential, e.g., +10 volts, whereby the secondary emission ratio is less than unity, thus causing the bombarded elements to charge to cathode potential. As pulse 45 slowly rises back to zero potential, electrons landing on elements 54 will continue to charge them negative, leaving them at the termination of the pulse at the low or zero equilibrium potential.

Reference having been made to the principle of the operation of bistable floating anode target elements in a VFD structure, reference is now made to FIGS. 3-6 illustrating a fluorescent display device 60. Display device 60 comprises a series of electrical components housed in a hermetically sealed housing or envelope 61. Display device 60 includes a substrate 62 formed of an insulating material, such as glass or ceramic or the like. Substrate 62 may be transparent for enabling the viewing of the displayed image from the substrate side of envelope 61. A pattern of parallel anode conductor strips or electrodes 66, which may be of a transparent conductive material, is formed on a surface of substrate 62. A cathodoluminescent target film or layer 68 is deposited upon each of the conductor strips 66. Layer 68 in this embodiment must be a relatively insulating phosphor material having high electrical resistivity so that it exhibits electrical floating properties. As previously mentioned, an example of such a phosphor material is $Zn_2SiO_4$.

Figure 4:
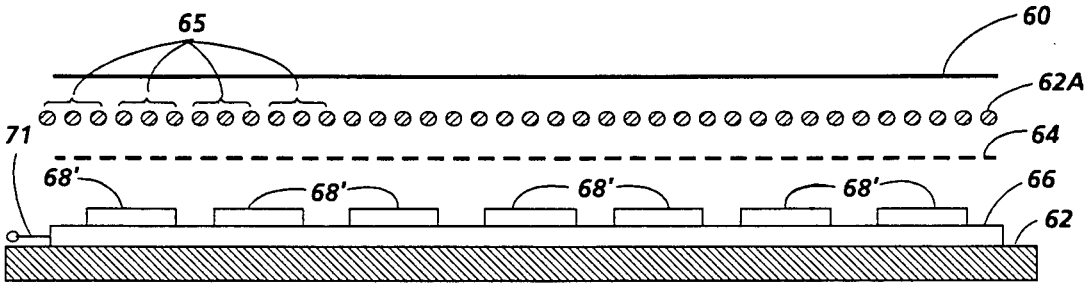
FIG. 4 is a schematic illustration of a side elevation of the vacuum fluorescent display shown in FIG. 1 taken along a plane perpendicular to the plane of FIG. 1 illustrating one form of the control grid means and anode phosphor layer for the VFD device of this invention.
Figure 5:
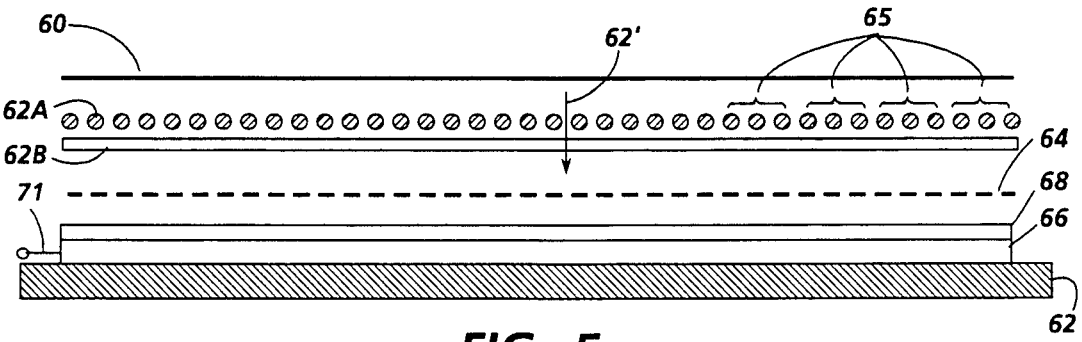
FIG. 5 is a schematic illustration of a side elevation of a vacuum fluorecent display shown in FIG. 3 taken along a plane perpendicular to the plane of FIG. 3 illustrating another form of the control grid means and anode phosphor layer for the VFD device of this invention.

Anode target elements 67A-67F comprise the combination of anode conductor strips 66 and overlying phosphor layer 68. These elements are elongated strips that are parallel, running perpendicular to the plane of FIG. 3. Phosphor elements 68 may extend for the full length of anode conductor strips 66, as illustrated in FIG. 5, or may consist of individual segments 68' spaced along the length of anode conductor strips 66, as illustrated in FIG. 4.

Figure 3:
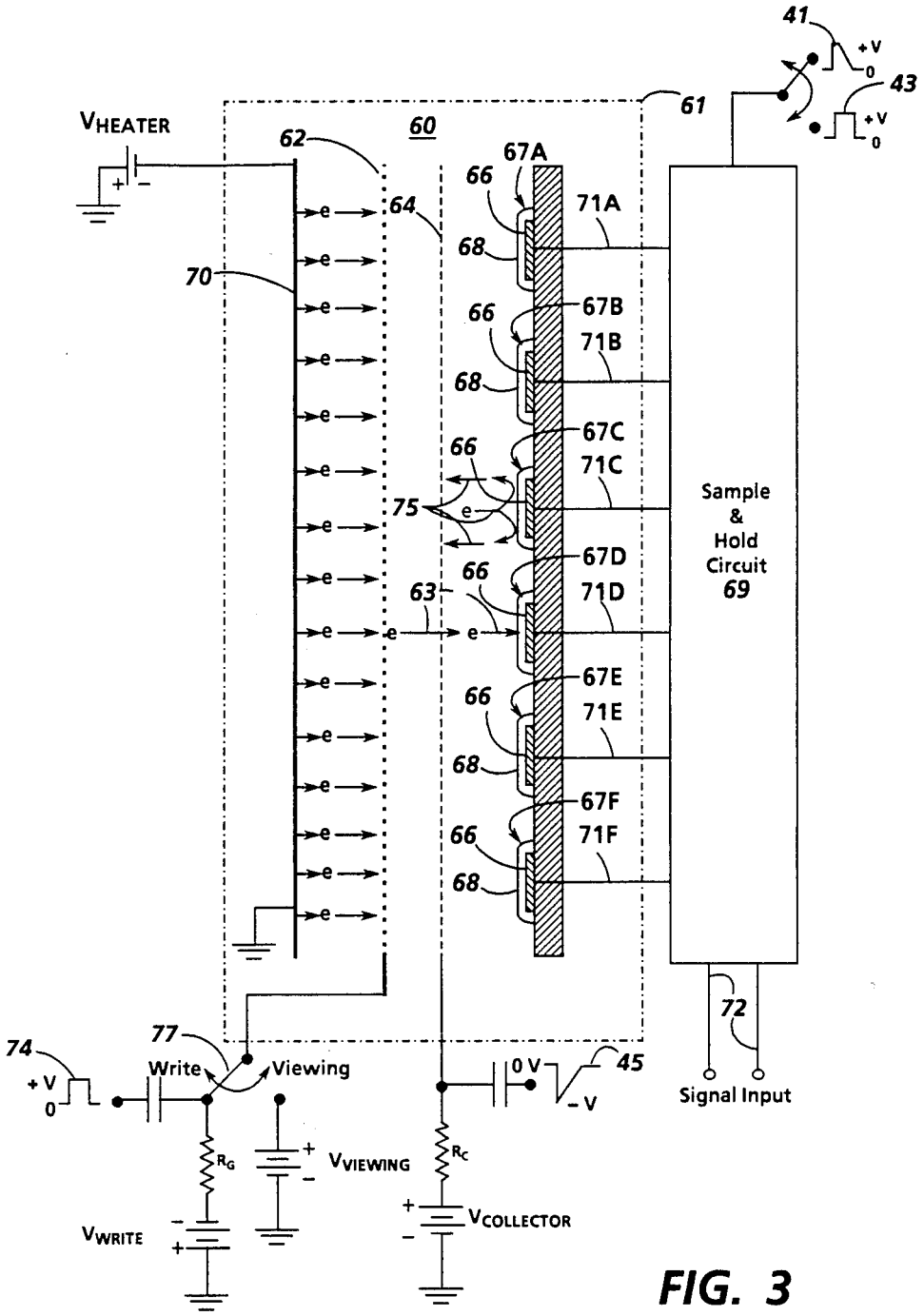
FIG. 3 is a schematic illustration of a side elevation of a vacuum fluorescent display (VFD) device comprising this invention.

In FIG. 3, although only six anode elements 67-67 are shown for simplicity, as display device 10 may contain several hundred or more anode elements across substrate 12. As an example, these strips may be 0.015" wide with a center to center spacing of 0.020".

Each of the conductor strips 16 of the anode target elements 67A-67F, is connected to the corresponding output of sample and hold circuit 69, which is provided with a signal input at 72. The signal placed on input 72 may be comprised of a time varying series of on and off pulses representative of the information to be transferred to the target elements 67A-67F. After this input signal is fed into circuit 69 and retained, an appropriate write or erase pulse is supplied to circuit 69 which, in turn, allows the pulses to be applied to the appropriate output line, 71A-71F. In this context, circuit 69 functions as a series to parallel converter which provides either writing or erasing pulses to the desired target elements 67A-67F. Circuit 69 may be designed so that while it is applying pulses to output lines 71A-71F, it can accept another series of input pulses which are held in a buffer and then used to control the output pulses applied to output lines 71A-71F corresponding to the next row of information. The timing of pulses on output lines 71A-71F is sequenced with the line-by-line addressing of control grid means 64, which will be explained in greater detail later.

Adjacent, in spaced relation, to substrate 62 and anode target elements 67A-67F is a collector 64, which may be a fine wire screen or mesh connected to a source of positive potential, $V_{COLLECTOR}$, e.g., +100 volts.

Adjacent, in spaced relation, to collector 64 is control grid means 66 which may be comprised of a plurality of elongated, parallel, spaced electrodes 62A arranged in a direction perpendicular to the elongated extent of anode conductor strips 66, as shown in FIG. 4. Alternatively, control grid means 62 may comprise, in combination, a first group of elongated, parallel, spaced electrodes 66A arranged in a direction perpendicular to the elongated extent of anode conductor strips 66 and a second group of elongated, parallel, spaced electrodes 62B in spatial relation to the first group but arranged in a direction parallel to the elongated extent of anode conductor strips 66, as illustrated in FIG. 5. Electrodes 62A and 62B may be comprised of metal wires suspended at their ends and may have a diameter in the range of several tens of microns. The individual electrodes 62A and 62B, or groups of such electrodes electrically connected together as indicated at 65 in FIGS. 4 and 5, are connected to a negative bias potential, $V_{GRID}$, e.g., −5 volts, with switch 77 in its write position as indicated in FIG. 3. Selected electrodes 62A, or 62A and 62B, or groups of such electrodes 65, may then be activated by switching from the negative bias potential to a positive potential via a positive pulse 74, e.g., +10 volts, as shown in FIG. 3, shifting the selected control grid electrode potential from −5 volts to +5 volts, permitting the localized transmission of electrons through the spaces between these wires.

In the embodiment of FIG. 5, the localized transmission of electrons occurs between cross points of electrodes 62A and 62B, such as indicated by arrow 62'. In utilizing this control grid arrangement, spot addressing of the underlying anode elements is possible so that in this particular embodiment, anode conductor strips 66 may be substituted by an area or two dimensional conductive plate having an insulating phosphor layer 68 for the full extent of the plate surface. In this embodiment, there would be a single input line 71 to which a positive potential would be applied, e.g., via pulse 41, to enable writing on the electrically floating two dimensional surface of layer 68 via selective activation of control grid electrodes 62A and 62B.

Adjacent, in spaced relation, to control grid means 62, is an extended area cathode 70 which may be comprised of one or more oxide coated fine wires. One end of cathode wires 70 may be fixed at reference or ground potential and, as explained in connection with previous embodiments, a low potential, $V_{HEATER}$, of several volts is applied to the other end of the wires to maintain them in a heated state and the resulting current flow produces a flood of primary electrons, as previously indicated in connection with FIGS. 1 and 2. Since a low voltage is applied to cathode 70, all parts of the cathode are maintained close to reference or ground potential.

As shown in FIGS. 4 and 5, luminescent target elements 67A-67F may comprise a plurality of phosphor segments 68' on conductor strips 66 or may consist of a continuous phosphor layer or film 68 coated on conductor strips 66.

The improvement of display device 60 over known VFD devices resides in the fact that addressed luminescent portions or segments of phosphor target layers 68 on anode conductor strips 66 are in an electrically floating state. Such floating target elements can be maintained in one of two equilibrium potential states and can be shifted from one state to the other by the application of suitable write or erase pulses 41 and 43 applied to the series of anode target elements 67A-67D. By comparison, in present day VFD devices, successive electrodes of control grid means 62 must be repetitively switched ON in a line-by-line fashion to produce an image. Since only one row of phosphor or luminescent elements is activated at a time, a limited average brightness is obtained which is progressively reduced as the number of rows of anode targets is increased. However, in display device 60, continuous scanning or refreshing of the display image is not required. Once selected anode target elements are triggered or switched on, they may remain in this state indefinitely and produce high brightness due to the bistable nature of the anode floating elements 68 when flooded with electrons from area cathode 70.

Functional operation of display device 60 is as follows. It will be assumed that display device 60 is in its relaxed state, i.e. there are no activated anode target elements 67A–67F since any preceding image has been erased by resetting all of anode target elements 67A–67F to cathode (zero) potential. In order to form a visible image via the luminescence of addressed portions or segments of target phosphor elements 68 or 68', individual grid electrodes 62A or 62B or groups of electrodes 65 of control grid means 62 are sequentially activated via a pulse 74, in line-by-line or group-by-group fashion simultaneously with pulse activation of anode target elements 67A–67F by write or erase pulses 41 and 45 supplied by circuit 69 to output lines 71A–71F. At addressed cross points of control grid means 62A and 62B, electrons from cathode 70 will locally pass through or between the electrodes of control grid means 62 and will be accelerated toward a row of anode strip or phosphor elements 68. If during this time, a write pulse 41 is applied to selected anode strips, selected phosphor elements along a row corresponding to the control grid electrode, which is pulse positive, will be triggered to the collector equilibrium potential state. This process is repeated sequentially for successive control grid electrodes until the entire image to be displayed has been created Once all of the selected anode elements have been addressed, all electrodes 62A and 62B of control grid means 62 are, then, switched to a positive dc potential, e.g. +5 volts, by shifting switch 77 in FIG. 3 from the write position to the viewing position, thus providing a uniform flood of electrons on anode elements 67A–67F. Those elements which had been triggered ON will now appear bright while the remaining elements are left in the OFF state and will appear dark. The resulting luminescent image produced will remain on indefinitely as long as the electron flood current is allowed to reach the anode elements producing an image of high brightness, for example, several hundred foot lamberts or more irrespective of the number of rows of picture elements that comprise the full extent of the display. Such a bright display level has a high utility in high ambient light environment, such as encountered by automobile dashboard instrument displays.

The image produced will remain on the anode target elements 67A–67F until erased. There is no requirement or necessity to refresh the displayed image by applying a duty cycle scanning of control grid electrodes to maintain the previously selected and addressed layer portions of anode elements 67A–67F in a state to continually accept the electron bombardment and repeatedly reproduce sufficient luminescence level for image viewing. In display device 60, once the anode element locations have been selectively switched from a low equilibrium potential state to above the first crossover potential, the electron flow will maintain the selected anode target element locations in steady state luminescence and brightness until the display device anode target elements are again reset to their low equilibrium potential state.

If desired selected elements of a luminescent image may be erased in a line-by-line fashion by a process similar to writing except that, in place of write pulses 41 applied to sample and hold circuit 69, erase pulse 43 are applied through this circuit. Alternatively, all of the elements may be erased at one time by applying an erase pulse 45 on collector 64 as previously explained in connection with FIG. 2.

Figure 6:
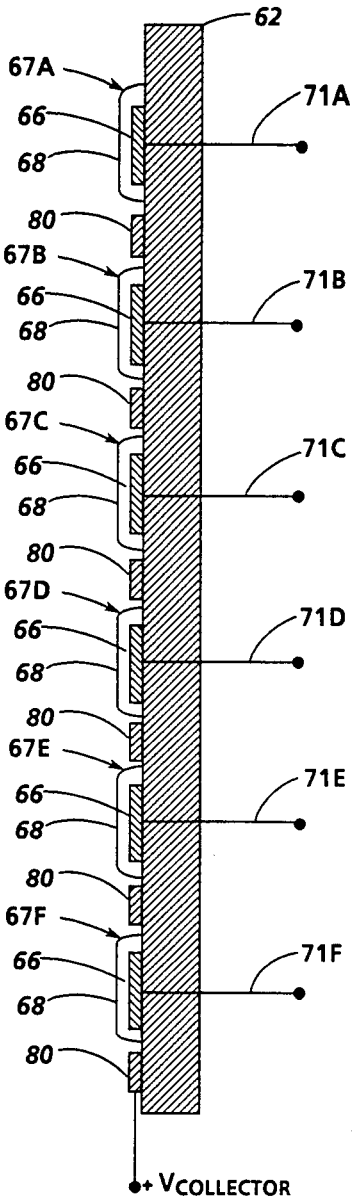
FIG. 6 is a schematic illustration of a side elevation illustrating another embodiment of the anode target/- collector arrangement for the VFD device of this invention.

It should be noted that collector 64 need not be in a separate plane from anode target elements 67A–67F. For example, as shown in FIG. 6, collector 80 comprises a plurality of etched metal conductors formed between adjacently spaced anode target elements 67A–67F with these metal conductors electrically connected together to a positive collector potential, $V_{COLLECTOR}$. The primary requirement of the collector is that it be located in close proximity to anode target elements 67A–67F where it can collect secondary electrons emitted by the target elements.

As previously emphasized, an important aspect of this invention is the requirement that fluorescent film or layer 68 of each anode target element 67A–67F be electrically floating, i.e., electrically isolated enabling its equilibrium surface potential states to be shifted by capacitive pulses supplied to the element. In this connection reference is made to FIG. 7 wherein there is shown an isometric view of an alternate anode structure 90 that may be used in place of substrate 62 and associated anode target elements 67A–67F of FIG. 3.

Structure 90 comprises an insulating substrate 92 upon which is deposited a group of elongated conductor strips 94 in spaced parallel relation across the surface of substrate 92. The exposed surfaces of strips 94 are then covered with an insulating film or layer 96. Finally, a plurality of anode segments 98 are formed on the surface of insulating film 96 in aligned rows overlying each individual conductor strip 94, as illustrated in FIG. 7. Anode segments 98 in this case may be comprised of conductive phosphor or other fluorescent material, e.g. ZnO, and need not be of the insulating type. Since segments 98 are electrically separated from conductor strips 94 by a portion 97 of thin insulating thickness of film 96. They are, in effect, electrically floating. In a complete display, conductor strips 94 are connected to sample and hold circuit 69 in the manner illustrated in FIG. 3.

FIG. 7 is only for illustrative purposes, as in practical application, a larger number of segment rows could be utilized, such as 250 rows with small spatial separation.

Other modifications of this invention will be apparent to those skilled in the VFD art. For example, instead of employing phosphor deposited as strips, the phosphor may be deposited in the form of a dot matrix. Further, segment phosphor elements or dot matrix phosphor elements may consist of repeated patterns of different luminescent materials which emit different colors, allowing multicolor images to be produced containing red, green and blue light.

Also, the fluorescent film or layer of phosphor material can be made electrically "leaky", so that in the absence of a flood electron current, the charges deposited on the anode elements which had been switched ON will leak off when the flood current is momentarily interrupted, allowing the surface of these elements to fall to the potential of the underlying anode conductor and return to their low voltage or initial equilibrium potential state. If a conducting phosphor material is in the form of a powder, e.g. ZnO, this material may be made less leaky or more insulating by incorporating an insulating powder, such as MgO or $Al_2O_3$. If an insulating phosphor material is is the form of a powder, e.g. $Zn_2SiO_4$, this material may be made leaky or more conductive by incorporating a conductive powder, such as ZnO or $In_2O_3$.

While the invention has been described in conjunction with a few specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A method of operating a vacuum display device having a cathode for supplying a flood flow of electrons and a plurality of anode elements having fluorescent properties with control grid electrodes interposed therebetween for the purpose of addressing and activating regions of the anode element fluorescent properties to form a two dimensional image for display and comprising the steps of:

electrically floating the anode elements in said display, sequential addressing said control grid electrodes concurrently with the sequential addressing of said anode elements to change the potential level of the electrically floating surface of the selectively addressed anode elements from a first equilibrium potential state to a second equilibrium potential state to form the two dimensional image, and activating all control grid electrodes upon completion of the step of sequential addressing.

2. The method according to claim 1 including the step of:

collecting electrons present in the region of the anode elements.

3. The method according to claim 1 including the steps of:

erasing the two dimensional image by addressing all of said control grid electrodes concurrently with addressing of all said anode elements with said electrical pulses to change the potential level the electrically floating surface of all inactivated anode elements of said display device from said first equilibrium potential state to said second equilibrium potential state and thereafter applying a potential to said anode elements to change the potential level of the electrically floating surfaces of all of said anode elements from said second equilibrium potential state to said first equilibrium potential state.

4. In a vacuum fluorescent display device comprising:

a substrate formed of insulating material, anode means including a phosphor layer deposited thereon, means to supply a positive potential to said anode means, a cathode mounted in spaced relation to said anode means to function as a primary electron source, control grid means mounted between said cathode and said anode means, means to supply a prescribed positive potential to selected of said control grid means to selectively activate underlying regions of said phosphor layer, the improvement wherein the surface of said anode means are electrically floating to function as bistable elements wherein said phosphor layer regions may selectively change to a second equilibrium potential state or remain in a first equilibrium potential state.

5. The vacuum fluorescent display device according to claim 4 including a collector means provided in close proximity to said anode means and maintained at a prescribed second positive potential to accelerate primary electrons emitted from said cathode and to collect electrons returning from anode means.

6. The vacuum fluorescent display device according to claim 5 wherein said collector means comprises a collector electrode positioned in spaced relation between said control grid means and said anode means.

7. The vacuum fluorescent display device according to claim 4 wherein said anode means comprise an anode conductor with an overlying phosphor layer having high resistivity or insulating properties.

8. The vacuum fluorescent display device according to claim 4 wherein said anode means comprise a phosphor layer having conductive properties, means to capacitively isolate said layer from said supply means.

9. The vacuum fluorescent display device according to claim 4 wherein said anode means comprises one or more anode conductors connected to said supply means, an insulating film formed over said anode conductors, and phosphor layers or phosphor segments deposited on said insulating film and aligned to overly said anode conductors.

10. The vacuum fluorescent display device according to claim 4 wherein said anode means comprises a plurality of spaced conductor strips, a phosphor layer deposited on said conductor strips, said control grid means comprising a plurality of spaced, elongated electrodes extending in parallel relation in a direction perpendicular to said strips.

11. The vacuum fluorescent display device according to claim 4 wherein said control grid means comprises a first group of spaced, elongated electrodes extending in parallel relation in a direction perpendicular to said anode elements and a second group of spaced, elongated electrodes positioned in close proximity to said first group of electrodes and extending in parallel relation in a direction perpendicular to said first group of electrodes.

12. The vacuum fluorescent display device according to claim 11 wherein said anode means comprises a conductive anode plate connected to said supply means and a phosphor layer deposited on said conductive anode plate.

* * * * *